US009103621B1

(12) United States Patent
Larson

(10) Patent No.: US 9,103,621 B1
(45) Date of Patent: Aug. 11, 2015

(54) QUIVER CONNECTION SYSTEM

(71) Applicant: Marlow W. Larson, Ogden, UT (US)

(72) Inventor: Marlow W. Larson, Ogden, UT (US)

(73) Assignee: Larson Archery Company, Ogden, UT (US)

( * ) Notice: Subject to any disclaimer, the term of this patent is extended or adjusted under 35 U.S.C. 154(b) by 309 days.

(21) Appl. No.: 13/672,959

(22) Filed: Nov. 9, 2012

Related U.S. Application Data

(60) Provisional application No. 61/628,947, filed on Nov. 9, 2011.

(51) Int. Cl.
*F41B 5/00* (2006.01)
*F41B 5/06* (2006.01)

(52) U.S. Cl.
CPC ..... *F41B 5/066* (2013.01)

(58) Field of Classification Search
CPC ..... F41B 5/066
USPC ..... 124/86, 88, 25.5, 25.7
See application file for complete search history.

(56) References Cited

U.S. PATENT DOCUMENTS

| | | | | |
|---|---|---|---|---|
| 4,685,438 | A * | 8/1987 | Larson | 124/25.7 |
| 5,190,022 | A * | 3/1993 | Larson | 124/25.7 |
| 6,105,566 | A * | 8/2000 | Tiedemann | 124/86 |
| 7,987,842 | B2 * | 8/2011 | McPherson | 124/86 |
| 8,596,256 | B2 * | 12/2013 | McPherson | 124/86 |
| 2008/0251059 | A1 * | 10/2008 | McPherson | 124/44.5 |
| 2011/0283982 | A1 * | 11/2011 | McPherson | 124/23.1 |
| 2012/0103315 | A1 * | 5/2012 | LoRocco | 124/25.7 |
| 2014/0083405 | A1 * | 3/2014 | McPherson | 124/88 |
| 2014/0182572 | A1 * | 7/2014 | Barnett | 124/25.7 |

OTHER PUBLICATIONS

1994 Browning Archery Catalog, p. 35, printed in USA.

* cited by examiner

*Primary Examiner* — Victor MacArthur
(74) *Attorney, Agent, or Firm* — Brian C. Trask

(57) ABSTRACT

A coupling system including a mounting plate for anchoring to a substrate and a pair of clasp elements for anchoring to an object to be coupled to the mounting plate. The mounting plate carries a longitudinal slot disposed at its distal end and a transverse slot disposed at its proximal end. Each clasp element is structured to define a groove shaped, dimensioned, and disposable to effect a press-fit registration with a respective slot. One clasp element is structured to form a press-fit installation into the transverse slot when the other resilient element is installed in press-fit registration in the longitudinal slot. Sometimes, the mounting system may include a deflection-limiting structure operable to resist wobble of a coupled object with respect to the substrate.

7 Claims, 1 Drawing Sheet

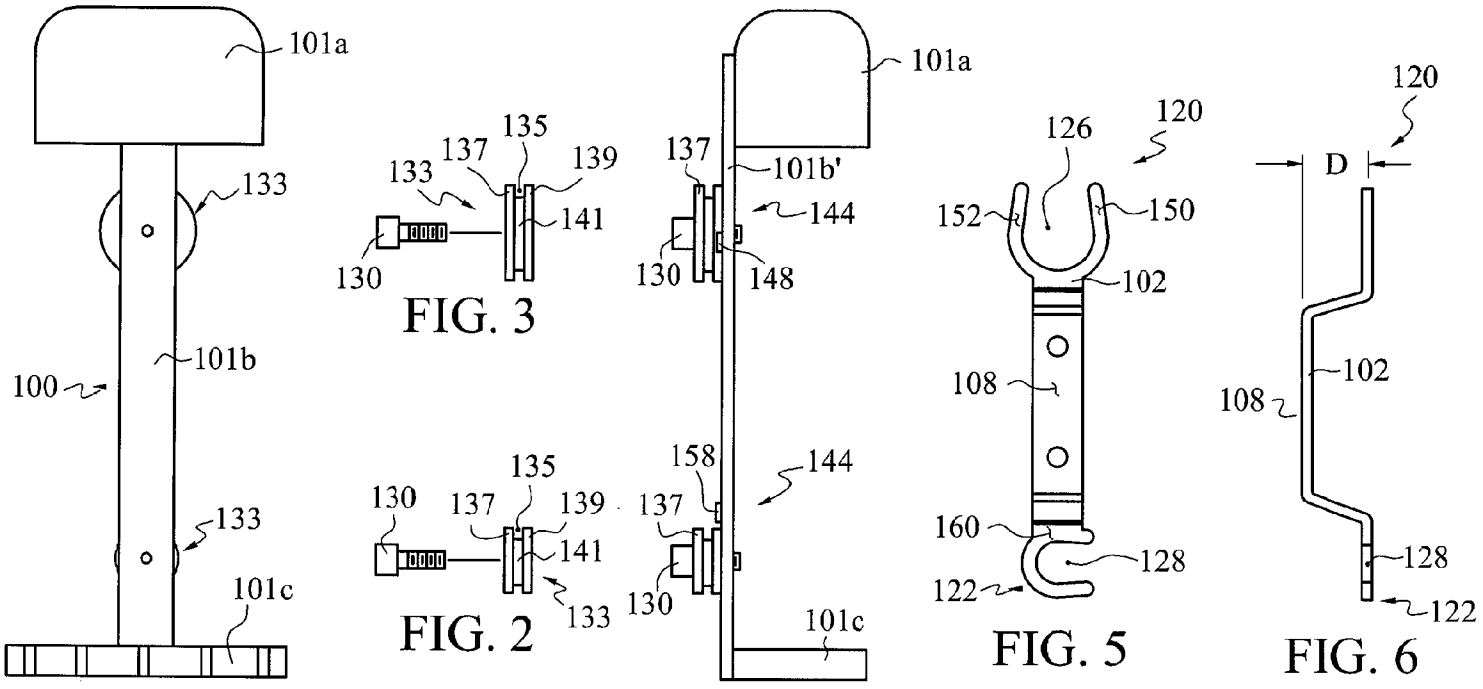
FIG. 6
FIG. 5
FIG. 4
FIG. 3
FIG. 2
FIG.1
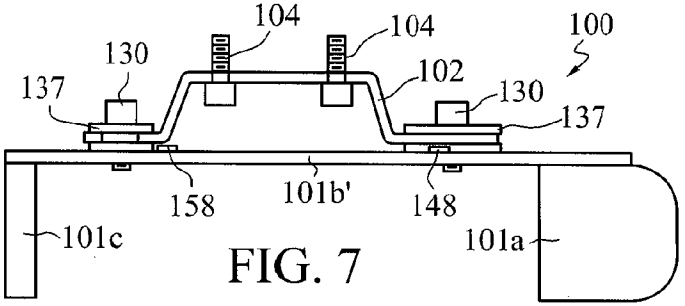
FIG. 7
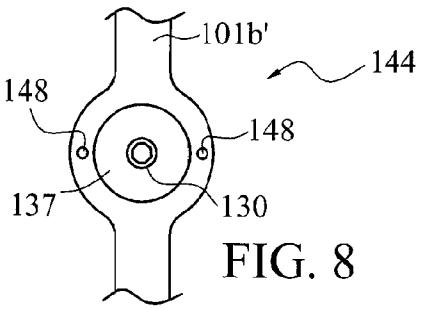
FIG. 8

QUIVER CONNECTION SYSTEM

CROSS-REFERENCE TO RELATED APPLICATIONS

This application claims the benefit under 35 U.S.C. 119(*e*) of the filing date of Provisional Application Ser. No. 61/628,947, filed Nov. 9, 2011, and Titled "ACCESSORY ASSEMBLIES FOR ARCHERY BOWS".

BACKGROUND OF THE INVENTION

1. Field

This invention pertains to archery quivers. It is more particularly directed an improved connection system for quickly attaching or detaching a quiver to the handle riser of a bow.

2. State of the Art

There is a need in the field for quivers that can be quickly and silently attached and detached from the handle riser of a bow. Several versions of interface structures have been proposed for accomplishing such a connection.

One example of a quick-connect quiver attachment system is the "Twist-Lock" quiver marketed by Browning, of Ogden, Utah. That quiver is easily fixed to mounting structure carried by the handle riser of a bow at two connection points. The first connection point comprises a male-female pivot connection formed by a clover leaf peg inserted through a congruently configured opening in the mounting structure. The second connection point comprises a slot in the mounting structure that captures a post carried by the quiver when the quiver is pivoted to effect a connection. This arrangement is illustrated at page 35 of the 1994 Browning Archery catalog, incorporated by reference as a portion of this disclosure. This arrangement permits the rapid attachment or detachment of the quiver by means of an easy 45 degree twist of the wrist. Attaching or detaching the quiver from the handle riser creates noise, however. Moreover, vibrations at the anchor points during use can cause distractions and be disruptive of the silence required for effective bow hunting.

A more recent example of a quick-connect quiver mounting system is the "quick-detach" system of the "Octane 1" quiver currently marketed by Octane Accessories, 90554 Highway 99 North, Eugene, Oreg. 97402. That system comprises a mounting plate with two slots, one parallel the long axis of the plate, and the other transverse that axis. The quiver carries two mounting posts. The plate is connected to the handle riser of a bow. The quiver is mounted by inserting one post in the longitudinal slot, and then swinging the quiver to register the second post with the transverse slot. The posts are made of non-metallic (Teflon) material so that attachment and detachment are relatively quiet. Nevertheless, significant noisy vibration still occurs at the relatively hard connection points during transit and use.

SUMMARY OF THE INVENTION

This invention constitutes an improved interface structure for rapid attachment and detachment of a quiver to a handle riser under field conditions where silence is of paramount importance. Embodiments of this invention are similar in basic construction to the "Twist-Lock" and "Octane 1" quivers, but specific details of construction ensure excellent vibration dampening. Through use of this system, the distractions of noise traceable to previous quiver mountings are reduced to a trivial level.

The interface structure of this invention comprises a modified "slot and post" arrangement in which a mounting plate presents a first, horizontal, slot and a second, vertical, slot. The mounting plate could be fixed to the quiver, but is more often attached to the handle riser. In either case, two pedestals, or posts, are mounted to the other structure (riser or quiver) in spaced arrangement to register, in turn, with the vertical slot and then, through a swinging motion, with the horizontal slot. The modifiers "vertical" and "horizontal" are with reference to the longitudinal axis of the mounting plate, it being recognized that the precise orientation of the interface structure with respect to the longitudinal axis of either the quiver and/or the bow is immaterial to the operability of the invention. The distal ends of both posts carry resilient deformable clasp devices constructed and arranged to effect a snug, press fit, or clamping, engagement with the mounting plate around substantially the entire interface region defined by the interior surfaces of the slots.

The clasp devices are constructed of elastomeric, or similar deformable material selected to exhibit long term resilience after repeated compressive deformations. The quiver is connected to the mounting plate by first forcing a first clasp device into the vertical slot and then pivoting the quiver about the interface between that slot and that first clasp, bringing the second clasp into press fit engagement with the horizontal slot. The connection procedure creates little, if any detectable noise. The press fit connections are sufficient to hold a loaded quiver in place without the aid of further mechanisms, although it is sometimes preferred to back up the tool-free, press-fit connection with a supplemental fastener. With modest effort, the quiver can be noiselessly detached from the handle riser by reversing the attachment procedure.

Preferred embodiments of this invention thus comprise a quiver mounting system, including a first element configured to mount to the handle riser of an archery bow, presenting a first slot oriented approximately parallel the longitudinal axis of the handle riser and a second slot oriented approximately transverse that axis. The slots are held spaced from the handle riser sufficiently to accommodate clamp structure carried by a second element configured for suspension from a quiver. The second element presents a first mounting post configured to register with the first slot and a second mounting post configured and positioned to permit it to be pivoted into registration with the second slot when the first post is registered with the first slot. Clamp structure, in the form of elastomeric clasp elements are carried at the distal ends of the first and second posts. The clasp elements are shaped, dimensioned and positioned to register with the first element at the boundary edges of the first and second slots. They are characterized by resilience and surface configurations effective to form a releasable press-fit mechanical grip with the first element at the first and second slots. Although other configurations are operable, the clasp elements ideally comprise cylindrical grommets with peripheral grooves configured to effect a tight press-fit along substantially the entire edges of the first and second slots. There are a number of materials available from which to fashion suitable clasp elements, thermoplastic elastomeric (TPE) material of medium hardness is currently preferred. TPE materials with physical resilience and wear properties identical or similar to those of 80 durometer TPU (urethane) materials are presently regarded as ideal.

BRIEF DESCRIPTION OF THE FIGURES

In the drawings, which illustrate what is presently regarded as the best mode for carrying out the invention:

FIG. 1 is a front view in elevation of an archery quiver carrying a portion of one embodiment structured according to certain principles of the invention;

FIG. 2 is a side view of a first clasp element;

FIG. 3 is a side view in elevation of a second clasp element;

FIG. 4 is a side view of another partially assembled embodiment;

FIG. 5 is a front view of a mounting plate component of a partially assembled embodiment of the invention;

FIG. 6 is a side view of the element in FIG. 5;

FIG. 7 is an assembled embodiment; and

FIG. 8 is a side view of a portion of the quiver illustrated in FIG. 4.

DETAILED DESCRIPTION OF THE ILLUSTRATED EMBODIMENTS

The present invention provides a coupling system, generally indicated at 100 in FIGS. 1 and 7, for attaching an object to a substrate, e.g. attaching a quiver (including hood 101*a*, stretcher 101*b*, and arrow-holder 101*c*) to a bow handle, in a virtually noiseless procedure effective to form a robust connection between the object and substrate.

The illustrated mounting plate 102 is intended for connection to a handle riser of a bow by means of bolts 104. In most cases, the bolts 104 register with threaded accessory mounting receivers, which are conventionally located on the risers of many conventionally structured compound bows. With the surface 108 of the mounting plate 102 held against the riser, its opposite end portions 120, 122 present a vertical or longitudinal slot 126 and a horizontal or transverse slot 128, respectively, spaced from the riser by a distance "D".

Mounting posts 130 extend through resilient, elastomeric clasps, generally 133, illustrated as cylindrical rubber grommets. As illustrated in FIGS. 2 and 3, elastomeric clasps 133 may be formed in a plurality of sizes and shapes, as desired. No matter how configured, the clasps 133 include a groove 135 shaped, dimensioned, and positioned to effect a press-fit registration with the longitudinal slot 126 and the transverse slot 128 of the mounting plate 102. Desirably, top washer 137, bottom washer 139, and core 141 cooperate to form a connection interface effective to isolate the mounting plate 102 from direct contact with a non-elastomeric surface. Vibration from all sources is effectively dampened by this arrangement. Attachment and detachment requires the same general manipulations as those used in connection with the Octane 1 and Twist-Lock quivers.

In the embodiment illustrated in FIG. 1, grommets 130 are relied-upon as essentially the sole means to resist all motion of a coupled object (e.g. a quiver) with respect to a mounting plate 102 to which the object is coupled. Sometimes, additional restraints are desired to limit gross movement, or wobble, of a mounting plate with respect to a coupled object, or vice-versa. With particular reference to FIGS. 4, 5, 7, and 8, deflection-limiting structure, generally 144, can be provided in certain embodiments of a coupling system 100.

An operable deflection-limiting structure 144 may be embodied as a pair of spaced-apart standoffs, such as posts 148 extending from alternate stretcher 101*b*' in FIGS. 4 and 8. Posts 148 are positioned adjacent to, but desirably spaced slightly apart from, surfaces 150, 152 on opposite sides of longitudinal slot 128 of a coupled mounting plate 102. Therefore, an installed mounting plate 102 remains isolated from direct contact with a non-elastomeric element, and vibration isolation is maintained for purpose of noise transmission during a coupling and uncoupling events. Small vibrations, such as produced during release of an arrow, are also effectively dampened. However, gross oscillation (wobble) of the coupled object about a longitudinal axis is resisted by formation of a structural interference between respective posts 144 and surfaces 150, 152.

An alternative deflection-limiting structure 144 may be embodied as a single standoff, such as rail 158, which extends transversely to the longitudinal axis of a coupled mounting plate 102. Similar to posts 144, it is preferred for rail 158 to be spaced slightly apart from surface 160 of a coupled mounting plate 102. Therefore, an installed mounting plate 102 remains isolated from direct contact with a non-elastomeric element, and vibration isolation is maintained for purpose of noise transmission during a coupling and uncoupling events. Small vibrations, such as produced during release of an arrow, are also effectively dampened. However, gross oscillation (wobble) of the coupled object about a longitudinal axis is resisted by formation of a structural interference exemplified by contact between rail 158 and surface 160.

While the invention has been described in particular with reference to certain illustrated embodiments, such is not intended to limit the scope of the invention. The present invention may be embodied in other specific forms without departing from its spirit or essential characteristics. The described embodiments are to be considered as illustrative and not restrictive. The scope of the invention is, therefore, indicated by the appended claims rather than by the foregoing description. All changes which come within the meaning and range of equivalency of the claims are to be embraced within their scope.

What is claimed is:

1. A quiver mounting system, comprising:

a first element configured to mount to the handle riser of an archery bow, presenting a first slot oriented approximately parallel the longitudinal axis of said handle riser and a second slot oriented approximately transverse said axis;

a second element configured for suspension from a quiver, presenting a first mounting post configured to register with said first slot and a second mounting post configured and positioned to permit it to be pivoted into registration with said second slot when said first post is registered with said first slot; and elastomeric clasp elements carried by said first and second posts, including grooves shaped, dimensioned and positioned to register with said first element at the boundary edges of said first and second slots:

whereby to effect press-fit connections of said posts to said slots such that a clasp element carried by said first post is disposed in contact with opposite side walls of said first slot, and a second clasp element is disposed in contact with opposite side walls of said second slot.

2. A quiver mounting system, comprising:

a mounting plate configured to permit anchoring said mounting plate to a handle riser of an archery bow and extending between proximal and distal ends along a longitudinal axis;

a longitudinal slot disposed at said distal end of said mounting plate;

a transverse slot disposed at said proximal end of said mounting plate;

a first resilient elastomeric clasp structured to define a groove shaped, dimensioned, and disposable to effect a press-fit registration in contact with opposite side walls of said longitudinal slot; and a second resilient elastomeric clasp structured to define a groove shaped, dimensioned, and disposable to effect a press-fit registration in contact with opposite side walls of said transverse slot when said first resilient element is installed in press-fit registration in said longitudinal slot, wherein:

said first resilient elastomeric element and said second elastomeric element are structured for anchoring on an object to be coupled with said mounting plate.

3. The quiver mounting system according to claim 2, further comprising:

a deflection-limiting structure operable to resist wobble of said object with respect to said handle riser without impeding damping of noise vibration.

4. A quiver mounting system, comprising:

a first element configured to mount to the handle riser of an archery bow, presenting a first slot oriented approximately parallel the longitudinal axis of said handle riser and a second slot oriented approximately transverse said axis;

a second element configured for suspension from a quiver, presenting a first mounting post configured to register with said first slot and a second mounting post configured and positioned to permit it to be pivoted into registration with said second slot when said first post is registered with said first slot; and elastomeric clasp elements carried by said first and second posts, said clasp elements being shaped, dimensioned and positioned to register with said first element at the boundary edges of said first and second slots and being characterized by resilience and surface configurations effective to form a releasable press-fit mechanical grip with said first element at opposite sides of said first and second slots.

5. The mounting system of claim 4, wherein said clasp elements comprise cylindrical grommets with peripheral grooves configured to effect a tight press-fit along substantially the entire edges of said first and second slots.

6. The mounting system of claim 5, wherein said grommets are fashioned from elastomeric material having resilience and wear properties of 80 durometer TPU material.

7. The mounting system of claim 4, further comprising:

a deflection-limiting structure operable, upon engagement of said first element with said second element, to resist wobble of said quiver with respect to said handle riser without impeding damping of noise vibration.

* * * * *